United States Patent [19]

Premel et al.

[11] Patent Number: 4,731,937

[45] Date of Patent: Mar. 22, 1988

[54] PROCESS AND APPARATUS FOR THE DRY SLUICING OF GRIT, SLAG OR SEDIMENTS FROM PRESSURIZED SYSTEMS

[75] Inventors: Ulrich Premel, Gummersbach; Ralf-Uwe Hartermann, Wiehl; Dietmar Deggim, Dortmund; Jürgen Poller, Holzwickede; Klaus Weinzierl, Dortmund, all of Fed. Rep. of Germany

[73] Assignees: L. & C. Steinmüller GmbH, Gummersbach; VEW Vereinigte Elektrizitatswerke Westfalen AG, Dortmund, both of Fed. Rep. of Germany

[21] Appl. No.: 811,526

[22] Filed: Dec. 20, 1985

[30] Foreign Application Priority Data

Dec. 21, 1984 [DE] Fed. Rep. of Germany ..... 3446808

[51] Int. Cl.[4] ..... F26B 7/00; F26B 17/14

[52] U.S. Cl. ..... 34/20; 34/65; 34/171; 432/83

[58] Field of Search ..... 432/77, 78, 79, 83; 110/238, 259, 165 R, 165 A; 34/20, 171, 178, 62, 65

[56] References Cited

U.S. PATENT DOCUMENTS 4,288,294 9/1981 Velling ..... 432/77
4,463,686 8/1984 Premel ..... 10/165

FOREIGN PATENT DOCUMENTS 2411086 9/1975 Fed. Rep. of Germany .
2856059 7/1980 Fed. Rep. of Germany .
2933716 3/1981 Fed. Rep. of Germany .
2817356 4/1983 Fed. Rep. of Germany .
3236753 3/1984 Fed. Rep. of Germany .
3446808 7/1986 Fed. Rep. of Germany .

OTHER PUBLICATIONS

Feeding Systems for Pressure Vessels—Chem. Ing-.—Tech 53 (1981), No. 5, pp. 335-336.

*Primary Examiner*—Larry I. Schwartz
*Attorney, Agent, or Firm*—Becker & Becker, Inc.

[57] ABSTRACT

A process for the dry sluicing of sediment from pressurized systems, such as gasification processes, in which gravitationally conveyed sediments are cooled to below their release temperature before removal. The sediments are cooled via indirect heat exchange, such as radiation cooling, to below their release point in a first zone, and are then further cooled indirectly as well as directly via cool countercurrent gas in a second zone to temperatures below 300° C., the sediment route in the second zone being lengthened by deflection of at least a part of the sediment, the sediment being removed via a sluice. The apparatus for performing the process includes a pressure resistant tank with a conical lower portion containing outlet branches, one outlet branch of which includes an externally cooled sediment conduit, the upper section of which includes straight and diagonal jacket surfaces, the bottom section including a vertical sediment shaft to which a first sluicing valve, a sluice and an additional sluicing valve are connected in sequence.

20 Claims, 1 Drawing Figure

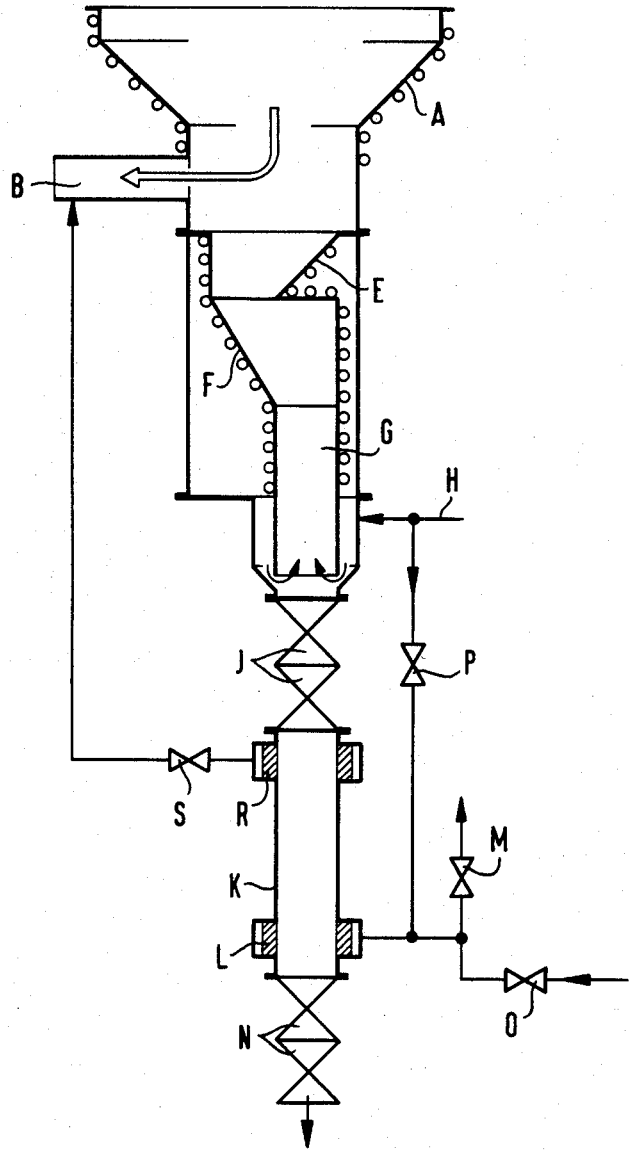
A
B
E
F
G
H
J
P
S
R
M
K
L
O
N

PROCESS AND APPARATUS FOR THE DRY SLUICING OF GRIT, SLAG OR SEDIMENTS FROM PRESSURIZED SYSTEMS

BACKGROUND OF THE INVENTION

1. Field of the Invention

The invention relates to a process and apparatus for the dry sluicing or removal of grit, slag or sediments from pressurized systems.

2. Description of the Prior Art

Sluicing systems are known in which sediments derived from a gasification process are cooled in a water bath and then removed by means of pressurized sluicing. This and similar processes have the fundamental disadvantage that there are problems to be resolved involving water and sediment management.

Further, sluicing systems are known in which fine flue ash is cooled in a convection cooler and then sluiced from the system.

This invention provides a dry process for sluicing coarse grit or sediments from gasification processes (for example partial and complete gasification of coal) thereby by-passing the need to resolve the problems associated with known processes.

SUMMARY OF THE INVENTION

In the process according to the invention sediments which appear in a gasification or other process are cooled indirectly, i.e. through radiation cooling to below their release or fusing point, whereupon, after the main gas stream has been led away, the stream of sediment, now being conveyed by the force of gravity, is deflected at least once and preferably several times from the vertical falling direction to a direction determined by deflection, which increases the residence time, in another cool zone where it is then likewise cooled indirectly, that is, from the outside, but is also simultaneously cooled directly to temperatures below 300° C. by a cold countercurrent gas, whereafter the sediment is sluiced from the system.

Cooling of the sediment from a temperature below the release temperature to a temperature allowing for removal of the sediments, i.e. temperatures less than 300° C., therefore results from combined exterior and interior cooling. This is done by increasing the length of the sediment removal route thereby enabling intensive cooling. As a result of the deflection of the sediment off the cooled surfaces, any sediment lumps are simultaneously reduced in size.

Direct cooling of the sediments in the initially diagonally and then vertically directed sediment conduit results from blowing a cool countercurrent gas into the lower end of the vertical sediment shaft. The cool gas can be used to cool the outside of the lower part of the sediment shaft by directing the gas such that it first flows around the outside of the lower part of the sediment shaft before it enters the interior of the sediment shaft from below and then leaves the pressure tank with the main gas stream.

Sluicing results in a known manner from alternate pressurization and depressurization by means of a sluicing gas. However, the sluicing is advantageously undertaken by retaining fine ash particles at the sediment outlet as well as at the sluicing gas outlet. Retention is advantageously achieved by means of sintered metal filters.

The apparatus according to the invention comprises a pressure resistant container with a conically tapering lower region to which is connected an outlet branch; at least the conically tapering lower region is cooled, preferably by means of cooling pipes welded to the part of the outer circumference which is to be cooled, the inside of the outlet branch having a sediment conduit which is cooled on the outside and comprises an upper section, into which the sediments are directed diagonally, and a second vertical sediment shaft to which a first sluicing valve, followed by a sluice as well as an additional sluicing valve, are connected.

The upper section of the sediment conduit is so arranged that it is not possible for the sediments to directly enter the vertically directed second section or sediment shaft. This section is only reached by way of opposed conical cooling surfaces.

The lower section of the vertical sediment shaft is cooled, in a preferred embodiment, by contact with a cool counter-current gas before the gas enters the sediment shaft from below. To this end, the section of the sediment shaft which is not provided with outer cooling pipes is surrounded by a jacket through which the cool countercurrent gas is passed.

Advantageously, all inner surfaces which come into contact with sediment are of a corrosion resistant material and are smoothly finished.

Although the sediments are already cooled to temperatures below their release temperature before reaching the conical lower region of the pressure tank, the lower region can also be cooled from the outside to prevent any sediment which is still soft from baking onto the conical lower surface. Cooling pipes are advantageously welded to the outside of the sediment conveyance structures inside the outlet branches of the pressure tank and to at least part of the sediment shaft.

A cooling jacket is provided on the lower section of the sediment shaft for additional cooling and cool counter-current gas is fed into it to flow over the outer surface of the sediment shaft before the gas enters the shaft from below.

The sluicing equipment which is the final stage in sediment removal, may be equipped with a sintered metal filter, preferably in the form of a ring, on the sediment outlet side as well as the sluice gas outlet side, to prevent the escape of fine sediment particles with the coarse sediments or the sluicing gas.

Sluicing is carried out in a known manner by cyclic pressurization and depressurization of the sluice via corresponding valves and conduits. Cool recirculated gas may be used as the principal pressurization gas.

BRIEF DESCRIPTION OF THE DRAWING

The process and apparatus of the invention are further described with reference to the accompanying process diagram.

DESCRIPTION OF PREFERRED EMBODIMENTS

Before reaching the conical base A, sediment from a process is cooled to below its release or fusing temperature (less than 900° C.) in a first cooler zone, which is not shown, by indirect heat exchange, preferably by means of radiation coolers.

At least part of the outer surface of the lower end of the cone A is cooled and this, in conjunction with the use of a smooth corrosion resistant material, prevents any of the sediments which are still soft from baking onto the inner surface of the conical base. Cooling of cone A is preferably achieved by welding cooling pipes to the outer surface thereof.

From the conical base A the sediment stream enters another cooled zone comprising a sediment conduit connected to the outlet branch of the pressure tank connected to the conical base A. The main gas stream is conveyed through the opening B. The sediment conduit comprises an upper section, including two opposed half cones E and F, and a lower vertical sediment shaft G. In falling from the conical base A the heavy sediment particles strike the surface of the cone E. From here they fall onto the diagonal surface F and then slide into the vertical shaft G. Here too, all inner surfaces coming in contact with sediments are smoothly lined. Sediment in the sediment shaft G is cooled, at the base of the shaft, by a cool countercurrent gas which is fed through a conduit H. By routing the countercurrent gas around the outer surface of the base of the shaft G, the gas also cools the inner wall in the lower region of the sediment shaft as well as a first sluicing valve J. Along the route from the conical base A to the lower end of the shaft G, the sediment is cooled to a temperature below 300° C.

The geometry of the actual removal apparatus, comprising two superimposed semi-conical conveying shafts E,F and a perpendicular shaft G, ensures that direct entry of sediment into the vertical shaft G is not possible. The diagonally opposed cooling surfaces not only produce an increase in the residence time in the sediment conduit, but the impact of the sediment on the lower cone surfaces results in an automatic reduction in size.

The sluicing valve J is connected to a sluice K. A sintered metal ring L is provided at the base in the sediment outlet region of the sluice K. The ring L prevents sediment particles from being carried along when the sluice is depressurized through a valve M. Upon opening a sluice valve N, the sediment falls down, thereby cleaning the sintered metal ring mechanically. The sluice K is pressurized by means of a valve O, so that the pressurizing process automatically cleans the sintered metal ring L.

Cold gas from the countercurrent gas supply can be supplied to the sluice K by means of a valve P when, for example, sufficient cooling is not achieved in the sediment shaft G as a result of excessive sedimentation. To this end, a sintered metal ring R is placed at the gas outlet end of the sluice through which cooling gas from the counter-current gas supply can be vented to the main gas stream via a valve S.

While the diameter of the sediment conduit reduces from the conical base A to the sediment shaft G, there is no further reduction until the point of extraction to avoid a build-up of sediment as a result of bridging.

The present invention is, of course, in no way restricted to the specific disclosure of the specification and drawing, but also encompasses any modifications within the scope of the appended claims.

We claim:

1. A process for the dry sluicing of sediment from pressurized systems, whereby gravitationally conveyed sediments are cooled to below their fusing temperatures prior to removal; said process including the steps of:

in a first zone, cooling said sediment via indirect heat exchange to below its fusing temperature and effecting said indirect heat exchange by radiation cooling so that said sediment is no longer liquid;

in a subsequent second zone, slipping and sliding sediment as solid particles in a gravity fall as well as further cooling said sediment indirectly and directly, by means of cool countercurrent gas, to temperatures below 300° C.;

deflecting at least part of said sediment during said slipping and sliding of sediment as solid particles in a gravity fall in said second zone in order to lengthen the time said sediment is retained in said second zone also for said further cooling to temperatures below 300° C.; and finally removing said sediment via a sluice.

2. A process according to claim 1, which includes the steps of: providing said second zone with an upper portion and a vertical lower portion, and deflecting said sediment from said upper portion at least once from a vertical falling direction into said lower portion.

3. A process according to claim 2, which includes the step of blowing said cool gas into said lower portion of said second zone countercurrent to said sediment.

4. A process according to claim 3, which includes the step of indirectly cooling said lower portion of said second zone with said cool counter-current gas.

5. A process according to claim 1, which includes the step of releasing pressure in the system in such a way that no sediment particles are carried out with gas.

6. A process according to claim 1, which includes the step of cooling said sluice with cool recirculated gas.

7. An apparatus for the dry sluicing of sediment from pressurized systems, said apparatus comprising:

a pressure-resistant tank having a conical lower portion;

an externally cooled sediment-guiding means that is connected to, and is in communication with, said conical lower portion of said tank for receiving sediment therefrom; said sediment-guiding means includes an upper section that is provided with alternating straight and slanted surfaces along which sediment is guided, and a lower section that is connected to said upper section and comprises a vertically extending sediment shaft;

a first sluicing valve connected to said sediment shaft;

a sluice connected to said first sluicing valve for receiving sediment therefrom; and a second sluicing valve connected to said sluice.

8. An apparatus according to claim 7 for dry sediment cooling and sluicing out from a pressure gasifier with a bottom having conical inflow and provided with cooling tubes and discharge struts connected thereto as well as a cooling duct clad with cooling tubes with feed for cold product gas arranged therebelow with a discharge sluice, said apparatus further comprising:

alternately inclined and straight mantel surfaces provided extending downwardly in an upper section of the cooling duct and a lower section thereof having vertical wall portion above a lowermost region of which the feed for the cold product gas is connected in a cooling mantel for this wall portion.

9. An apparatus according to claim 8, in which all surfaces of cooling device coming into contact with the sediment are smooth.

10. An apparatus according to claim 9, in which a sluice chamber means at a sediment discharge end thereof has a sinter-metal filter especially in a shape of an S-ring.

11. An apparatus according to claim 7, in which said conical lower portion of said tank is at least partially provided with external cooling means.

12. An apparatus according to claim 11, in which said external cooling means are in the form of cooling pipes welded to said conical lower portion.

13. An apparatus according to claim 7, which includes a cooling jacket that surrounds that portion of said sediment shaft remote from said upper section of said sediment-guiding means.

14. An apparatus according to claim 7, in which all inner surfaces that come into contact with sediment are smooth.

15. An apparatus according to claim 13, in which cooling pipes are welded to the outside of said upper section of said sediment-guiding means, and to the outside of that portion of said sediment shaft disposed between said upper section and said cooling jacket.

16. An apparatus according to claim 15, in which that portion of said sluice adjacent to said second sluicing valve is provided with a sintered metal filter.

17. An apparatus according to claim 16, in which said filter is in the form of a sintered metal ring.

18. A process for dry sediment cooling and sluicing out from gasification procedure occurring under pressure, subject to gravity-force conveying, comprising the steps of:

first cooling the sediment to below softening temperature thereof by indirect heat exchange and a further cooling off occurs via indirect cooling as well as a direct cooling with cold product gas in counterflow, whereupon the sediment is sluiced out;

secondly, after the cooling off of the sediment to below softening temperature thereof, slipping and sliding sediment as solid particles in a gravity fall as well as further cooling off thereof occurring first in free fall;

deflecting the sediment at least once out of falling direction thereof during the gravity fall in order to lengthen the time the sediment is subjected secondly to said slipping and sliding as well as said further cooling to temperatures below 300° C.; and finally removing said sediment via a sluice.

19. A process according to claim 18, which includes a step of final cooling of said sediment additionally indirectly via product gas conveyed in direct flow.

20. A process according to claim 19, which includes a step of also cooling the sediment with cold product gas in the sluice.

* * * * *